United States Patent [19]

Ljokkoi

[11] Patent Number: 4,915,822

[45] Date of Patent: Apr. 10, 1990

[54] METHOD AND APPARATUS FOR TREATING FIBER SUSPENSION

[75] Inventor: Risto A. Ljokkoi, Karhula, Finland

[73] Assignee: A. Ahlstrom Corporation, Noormarkku, Finland

[21] Appl. No.: 256,694

[22] Filed: Oct. 2, 1988

[30] Foreign Application Priority Data

Oct. 13, 1987 [FI] Finland ..... 874498

[51] Int. Cl.[4] ..... B07B 1/20

[52] U.S. Cl. ..... 209/273; 209/250; 209/306

[58] Field of Search ..... 209/250, 254, 270, 268, 209/273, 380, 306; 210/413, 414; 162/55

[56] References Cited

U.S. PATENT DOCUMENTS

| | | | |
|---|---|---|---|
| 2,796,809 | 6/1957 | Sprau | 209/273 |
| 3,759,392 | 9/1973 | Syrjanen | 209/273 X |
| 4,374,728 | 2/1985 | Gauld | 209/273 |
| 4,585,551 | 4/1986 | Musselmann et al. | 209/273 X |
| 4,642,189 | 2/1987 | Hooper | 209/273 X |
| 4,744,894 | 5/1988 | Gauld | 209/273 |

FOREIGN PATENT DOCUMENTS 66218 9/1979 Finland .

*Primary Examiner*—Donald T. Hajec
*Attorney, Agent, or Firm*—Toren, McGeady & Associates

[57] ABSTRACT

A method and an apparatus for treating a fiber suspension wherein the fiber suspension is fed into a treatment apparatus having treatment zones and divided into two fractions, an accept and a reject, the reject being guided from one zone behind at least one adjacent treatment zone to a separate reject treatment zone, in which the remaining accept of the suspension is discharged. The apparatus being divided into a plurality of axial zones and having a rotor and at least one screen arranged in an outer housing, and in the treatment space between the screen and the rotor, members are arranged for guiding the suspension from the different treatment zones of the treatment space to the separate reject treatment zone.

7 Claims, 5 Drawing Sheets

(PRIOR ART)

METHOD AND APPARATUS FOR TREATING FIBER SUSPENSION

BACKGROUND OF THE INVENTION

The present invention relates to a method and apparatus for treating a fiber suspension, in which the method fiber suspension is fed to the treatment apparatus, and impurities and too large particles are separated from the suspension. The method and the apparatus in accordance with the present invention are especially suitable for screening suspensions in the sorters of the pulp and paper industry.

The sorters known from the prior art most often comprise an apparatus to which pulp is fed continuously and which has one or more stationary screen cylinders and a rotor moving adjacent to the surface of these cylinders. Pulp is fed axially to the space between the screen surfaces/surface and the rotor, subsequent to which and due to the operation of the rotor the pulp is brought into a circulating, spiral movement. During the screening the acceptable fraction passes through the screen surface and is discharged as an accept and the coarser fraction flows in axial direction along the screen surface from the inlet end to the outlet end of the cylinder, from which end it is discharged as a reject.

FIG. 1 is a schematic illustration of the above described prior art sorter, which has for simplicity only one screen cylinder and a closed rotor inside the cylinder. FIG. 2 is a graphic illustration of how by means of showing the described method the amount of the reject is increased between the screen surface and the rotor evenly as a function of the height of the cylinder. FIG. 3 is a corresponding graphic illustration of the amount of the accept flowing through the screen cylinder as a function of the height of the screen cylinder. It can be seen that the accept flow is at its maximum, of course, at the upper end of the screen cylinder, and therefrom the amount of accept decreases rapidly, because the relative portion of the reject in the material to be screened increases rapidly and on the other hand the reject tends to clog the screen surface. Thus the problem is that the actual capacity of the screen surface is used only partially, in other words the screen surface is used only at partial efficiency.

A possible solution to the above described problem could be, e.g. the use of a conic rotor, whereby more material to be screened may be introduced between the screen cylinder and the conic rotor. But also, in this case, the relative portion of the reject in the space between the screen surface and the rotor increases in the similar way as in a previously described arrangement. However, it has to be admitted that a slightly better screening capacity of the screen surface is achieved by a conic rotor than by a rotor in accordance with FIG. 1, because fresh unsorted suspension may be fed deeper in the space between the screen surface and the rotor.

A second possible solution is described in U.S. Pat. No. 4,642,189 which discloses a substantially conic rotor, the upper end of which is, however, formed in a way that the pulp to be fed is divided into three annular portions one within the other, is fed in at a different height in the space between the rotor and the screen surface. FIGS. 4 and 5 are graphic illustrations showing the amount of the reject and of the accept flow passing through the screen surface as a function of the height of the screen cylinder. It can be seen in FIG. 4 that the amount of the reject increases gradually according to the different feed points of the material. A broken line in the figure shows the situation, in which the feed between the rotor and the screen surface is carried out in one stage. Thus the slashed area shows the advantage achieved with the arrangement in accordance with said publication compared with the arrangements described above. FIG. 5 clearly illustrates the three-stage-nature of the feed of the material. Each feed stage generates an addition, in other words a step, to the accept flow, and after each feed the accept flow reduces according to FIG. 3, yet in a way that the speed, of reducing of the accept flow after each feed increases the deeper the feed between the rotor and the screen surface is carried out, because the increasing amount of reject decelerates the accept flow more intensively the greater the amount of the reject in the space is. The broken line in the figure signifies the situation in which the feed is carried out in one single stage directly from the end of the screen cylinder. The slashed area shows the amount of the volume flow which additionally passes through the screen surface by using this method of feeding.

In the patent, the feed stages of the unsorted pulp take place in the steps of about 20% considering the total height of the screen cylinder. It is not advantageous to arrange feed stages below the vertical middle of the screen cylinder, because they would hardly be of any use anymore compared with the above described curves. Since it has been necessary to arrange a feed of dilution liquid through the rotor to the lower part of the screen cylinder, the problem with the arrangement in accordance with said invention seems to be the excessive thickening in the space between the rotor and the screen surface.

A common problem to all described arrangements of the prior art is the even increase of the amount of the reject between the screen surface and the rotor. Because the reject generates a particular flow resistance to the screening process, the screening efficiency achieved is not much better than that of a traditional screen apparatus illustrated in FIG. 1, unless it is possible to remove reject from the area between the ends of the screen apparatus, in other words to reduce the flow resistance in the space between the rotor and the screen surface caused by the reject.

SUMMARY OF THE INVENTION

Accordingly, it is an object of the present invention to eliminate or minimize the defects of the apparatuses according to the prior art and to increase the capacity of the screen apparatuses significantly without changing the actual screen cylinder and without increasing costs compared to the prior art arrangements.

The above described objects are achieved by a method which is characterized in that reject is guided in the treatment space at least from one zone past the next treatment zone of the suspension to a separate treatment zone of the reject, in which the fraction that is still acceptable is separated from the reject. The apparatus realizing this method is characterized in that members are arranged in the rotor, which guide the material accumulated in the treatment space between the rotor and the screen surface from the different stages of the treatment space to a treatment zone arranged particularly for the accumulated material.

The invention is described below in detail, by way of example, with reference to the enclosed drawings.

DETAILED DESCRIPTION OF THE PREFERRED EMBODIMENT

Figure 1:
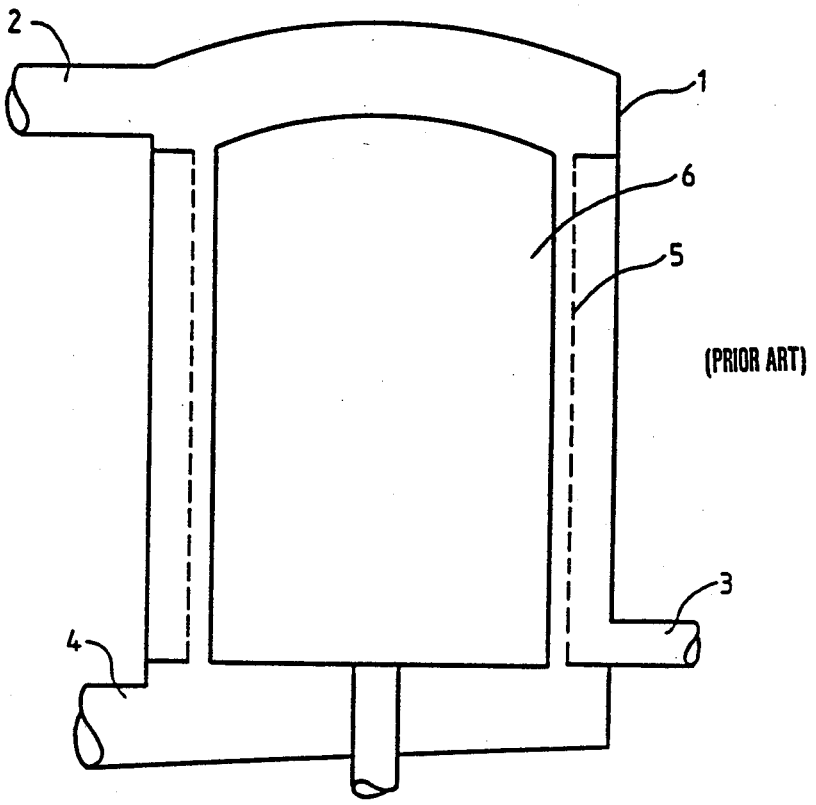
FIGS. 1–5 are illustrations of apparatuses and their capacity described in the prior art.

The invention relates in principle to a screen apparatus in accordance with FIG. 1, which manly comprises an outer casing 1, conduits arranged in it for a pulp to be fed 2, for an accept 3 and for a reject 4. Inside the outer casing there is a screen or filter surface 5 and adjacent to this surface a member 6 is located movable relative to the surface 5, a so called rotor.

Figure 6:
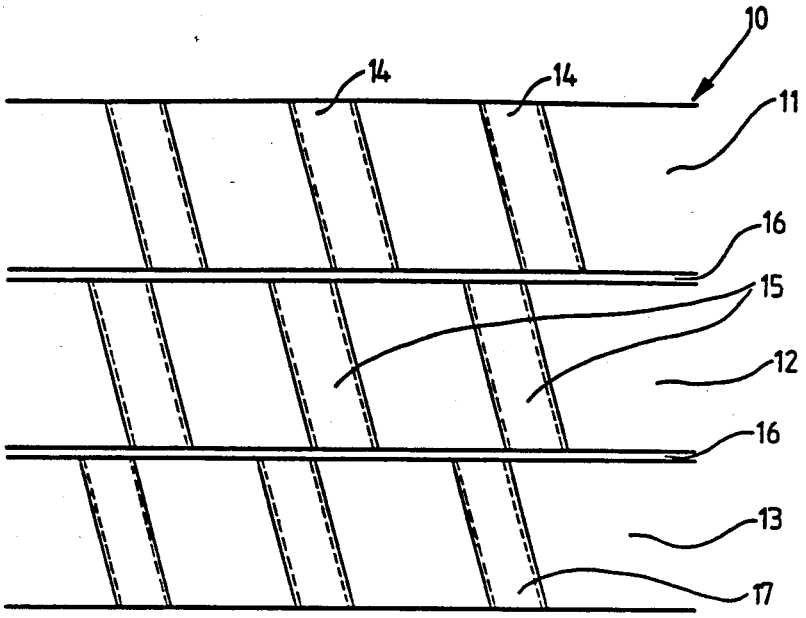
FIG. 6 is a schematic illustration of the present operating principle of the method and apparatus in accordance with the present invention.

FIG. 6 introduces the operating principle of the method in accordance with the present invention. According to FIG. 6 a treatment space 10 for the fiber suspension, e.g. the space between screen surface 5 and rotor 6 of FIG. 1, is divided axially into three zones 11, 12 and 13, which can be of the same size in the axial direction, but they may also differ in size. The pulp is conventionally fed substantially in an axial direction to the treatment space 10, but a portion of the pulp is guided past the first zone 11 directly to the second zone 12 by means of a member 14, whereby the screen surface of both the first zone 11 and the second zone 12 receives unscreened pulp to be treated. After the screening process is over in the first zone 11, in other words the pulp has circulated its spiral passage downwardly along the screen surface, the accept has flowed through the openings of the screen surfaces and the reject has been separated to its own layer, at least a part of the reject is led by a member 15 directly past the second zone 12, without mixing with the suspension in the second zone 12, to the third zone 13 serving as a reject treatment zone, in which the separation of the acceptable fraction still flowing with the reject is carried out and the acceptable fraction is guided to the accept. Thus the amount of the reject flowing to the second zone 12 and decelerating substantially the separation is decisively reduced, whereby the capacity of the screen apparatus shown in FIGS. 7 and 8 is achieved.

Figure 2:
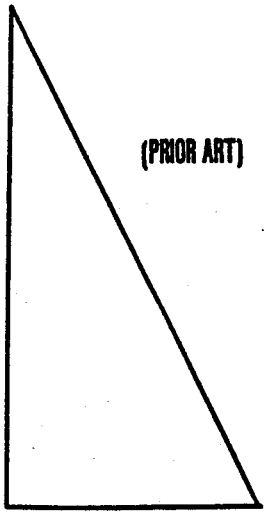
Figure 4:
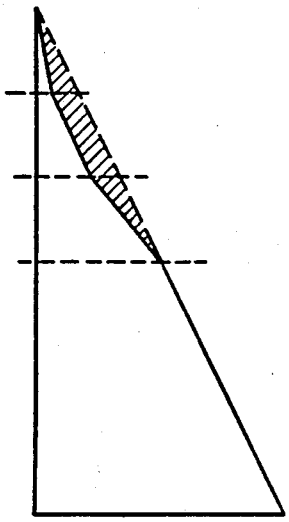
FIG. 4 (PRIOR ART)
Figure 7:
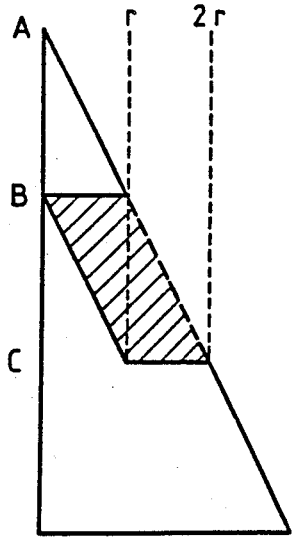
FIG. 7 is a graphic illustration of the resistance caused by the reject of a screen apparatus operating on the principle in accordance with FIG. 6.

FIG. 7 shows the amount of reject accumulating in the treatment space of the screen apparatus utilizing the method in accordance with the invention as a function of the height of the screen surface similar to FIGS. 2 and 4. At the beginning A of the first zone 11 the amount of the reject is, of course, 0, from which it increases evenly to a value r. Thereby the reject is guided directly past the second zone 12 to the third zone 13. Thus the amount of the reject at the beginning B of the second zone decreases back to zero, from which value it rises again to the value r when reaching the border surface C between the second and third zones. At the beginning of the third zone 13 the amount of the reject rises to a value 2r, because the rejects of the first and the second have joined together. In the third zone 13 the increase of the amount of the reject corresponds with the apparatus of FIG. 1 illustrated in FIG. 2. FIG. 7 shows by broken lines the situation of FIG. 2, whereby the slashed area presents the benefit achieved by the invention compared with the apparatuses known in the prior art.

Figure 8:
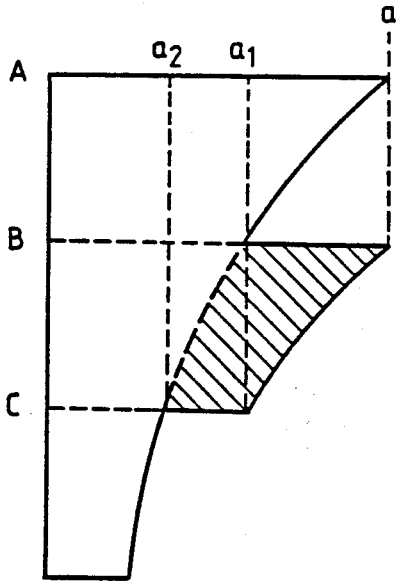
FIG. 8 is a graphic illustration of the accept flow of the screen apparatus operating on the principle in accordance with FIG. 6 through the screen surface;.

FIG. 8 illustrates as a function of the height of the screen surface the change of the amount of the accept in the embodiment according to the present invention. It has to be noted that the uppermost part a is of similar size in FIGS. 3, 5, and 8, because it illustrates the maximum flow through a particular screen surface at a particular pressure difference. Thus it does not make any difference how great an amount of the suspension is fed to the treatment space, in other words how open the treatment space is in the upper end of the screen cylinder (whether it is a conic or cylindrical rotor). Only the pressure difference prevailing over the screen surface is relevant. As is seen in the figure, the volume flow through the screen surface decreases during the first zone exactly corresponding to FIG. 2 to a value $a_1$, until the border B of the first and the second zones is reached, whereby the volume flow rises back to its minimum value a, because there is no reject in the second zone decelerating the screening. The curve of the second zone is exactly parallel to that of the first zone, in other words the volume flow reduces to the value $a_1$. When the second zone changes to the third at point C the volume flow reduces to the value $a_2$, which again is in accordance with FIG. 2, as the broken line in FIG. 8 shows. The slashed area shows the greater amount of the volume flow achieved by the method and apparatus in accordance with the present invention compared with the arrangements known in the prior art.

Figure 9:
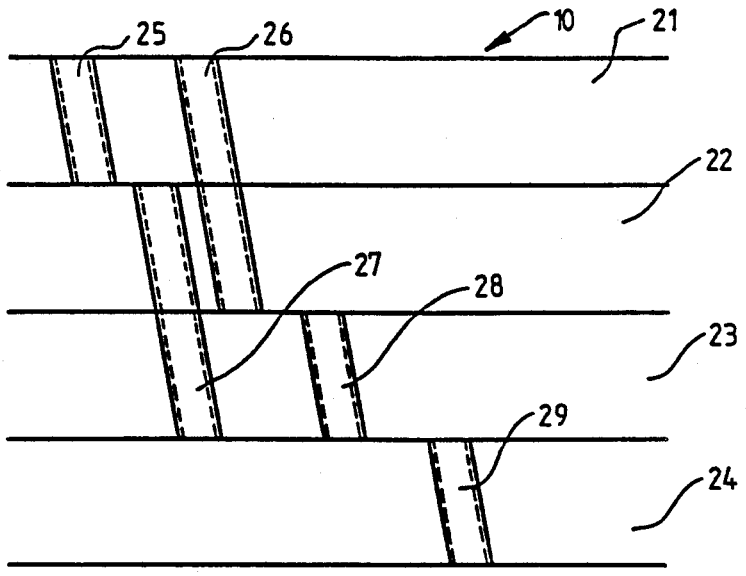
FIG. 9 is a schematic illustration of an alternative operating principle of the method and apparatus in accordance with the present invention.

FIG. 9 illustrates an alternative embodiment of the method and apparatus in accordance with the present invention, in which the treatment space is divided into four separate zones 21, 22, 23 and 24. The pulp flowing into the treatment space 10 is divided into three portions in such a way that about one third of the unsorted suspension is brought directly to the first zone 21, about one third is guided by a member 25 to the second zone 22 and about one third by a member 26. to the third zone 23. Respectively the reject generated in the first zone is guided past the second and third zone directly to the fourth zone 24 by a member 27 as well as the the reject of the second zone past the third zone by a member 28. The reject of the third zone flows directly to the fourth zone. Thus the reject of the previous zones does not flow to the second 22 or third 23 zone to decelerate the screening.

Figure 10:
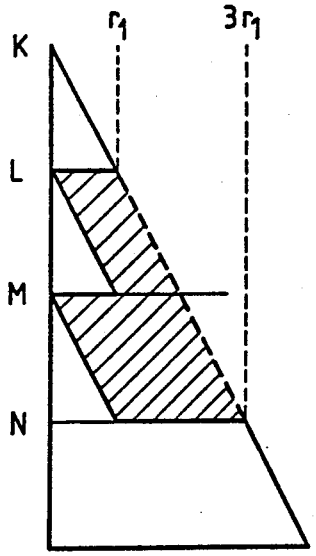
FIGS. 10 and 11 are graphic illustrations of the amount of reject and the accept flow of the alternative of FIG. 9 in the same way as FIGS. 7 and 8 illustrate the alternative of FIG. 6.
Figure 11:
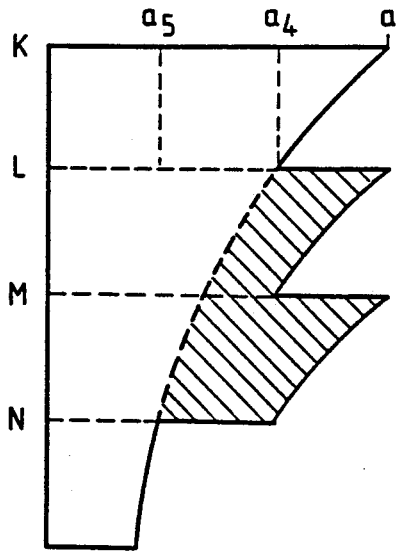

FIGS. 10 and 11 respectively illustrate the capacity as above described. The amount of the reject according to the FIG. 10 decreases to zero at the beginning of the second zone L and the third zone M an increases in each three first zones from zero to the value $r_1$. At the beginning of the fourth zone N the amount of the reject rapidly increases to the value $3r_1$, because also the rejects of the first and second zone, in other words the rejects of all preceding zones are guided to the fourth zone. The slashed area shows the advantage gained by the method compared with the conventional system. FIG. 11 shows that at the beginning of the second and the third zone the pulp flow of the accept increases to its maximum a and decreases at the end of each zone to a value $a_4$ due to the reject accumulated in the zone. At the beginning of the fourth zone the volume flow decreases to a value $a_5$, because the amount of the reject in the material to be screened has increased for the reason already described above. Similar to the previous drawings the slashed area illustrates the advantage gained by the method and apparatus in accordance with the invention compared with the apparatuses of the prior art.

Figure 3:
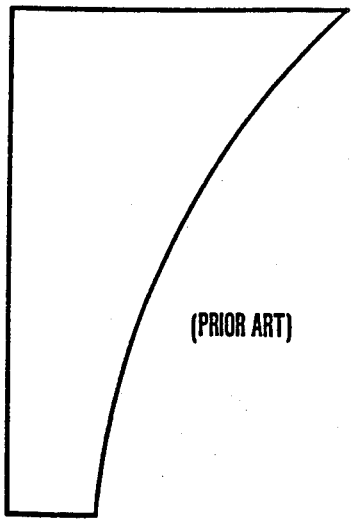
Figure 5:
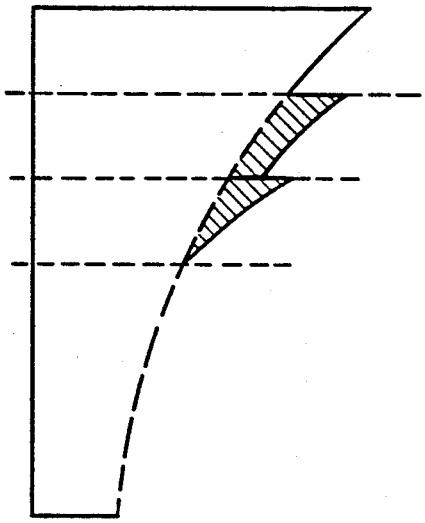
Figure 12:
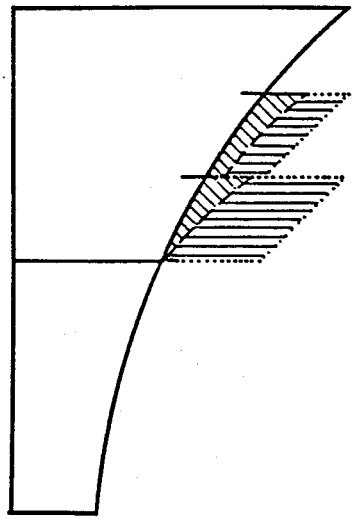
FIG. 12 is a graphic illustration of the comparison between the method and apparatus according to the present invention and those of the prior art.

FIG. 12 illustrates a comparison of the graphs of FIGS. 3 and 5 showing the operation of the apparatuses of the prior art and the capacity being achieved by the method an apparatus in accordance with the invention. The unbroken line illustrates FIG. 2 showing the conventional technique, the broken line indicates the operation of the arrangement in accordance with U.S. Pat. No. 4,642,189 (FIG. 5) and the dotted line illustrates the capacity of the method and apparatus in accordance with the present invention. It must be noted that in illustrating the invention in FIG. 12 an arrangement with four zones has been used, in which the division of the zones is similar to that of the apparatus in accordance with said US patent. This arrangement is used in order to make the comparison between the capacities of the different arrangements in the clearest manner.

It can be seen in FIG. 12 that during the first zone there are no differences to be seen between the apparatuses, but all devices are capable of treating the same amount of stock so that the accept is the same in every case. In the second zone the improvement according to the invention (horizontal lining+slashing) compared to that of U.S. patent (slashing) is double and in the third zone already at least triple. Notwithstanding the fact that the invention already in this kind of comparison is superior to the known arrangements, it has to be noted that the difference compared with the known technique might be much greater if the zone division according to the invention were, for example, similar to FIG. 9. Thereby the advantage to be achieved compared with the apparatus in accordance with the US patent might be of quite another scale.

Figure 13:
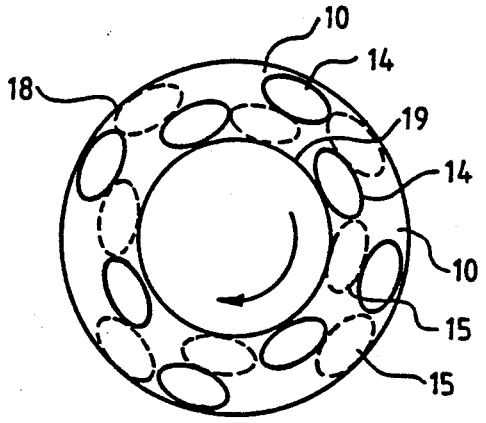
FIG. 13 is a schematic illustration of an embodiment of an apparatus in accordance with the present invention.

FIG. 13 discloses a schematic cross-sectional view of a screen apparatus in accordance with the invention in which the treatment space 10 is formed between two stationary screen cylinders 18 and 19. A rotatable rotor is arranged in the treatment space 10, and comprises a plurality of axial or almost (±30°) axial hollow foils 14 and 15. Foils 14 as well as the foils 15 are arranged by turns adjacent to the screen surfaces 18 and 19 and their cross-section is formed so as to keep the screen surfaces clean. The length of the foils 14 and 15 may vary in the same way as in FIGS. 6 and 9, or, of course, if there are more zones even the lengths of the foils may vary respective to the height of the screen surface. According to FIG. 6 foils 14 and 15 are mounted to plates 16 to be better seen, to the lower one of which the foils 17 are mounted to keep the screen surface of the third zone 13 clean. The intermediate plates 16 have for the foils 14 and 15, through which the unsorted suspension is brought from the inside of foil 14 to the second zone and from which the reject of the first zone 11 flows to the foil 15 which guides the reject past the second zone 3 to the third zone 13. When it is necessary the intermediate plate 16 may otherwise be completely closed, thereby no suspension flows to the first zone 11 or reject separated from the suspension may flow to the second zone. Corresponding intermediate plates are used, of course, also between other zones. If the apparatus is a three-zone type as in FIG. 6, it is advantageous to arrange the relation of the sum of the cross-sectional surfaces of blades 14 and the cross-sectional surface of the whole treatment space to be about 1:2, whereby one half of the suspension flows to the first zone 11 and the other half through the hollow foils 14 to the second zone 12. It is clear that both hollow foils receiving unsorted suspension and reject and more precisely the ends of the foils may be formed, e.g. scoop-like, for facilitating the introduction of the pulp. Although the references made in the above description are mainly made to refer to the embodiment in accordance with FIG. 6, the same features are true also for the embodiment in accordance with FIG. 9, in which the only exception is, for example, the extension of a member 26 or a member 27 over two zones, in other words said foils pierce the intermediate wall between different zones. Respectively, it is advantageous to divide in this embodiment the unsorted suspension flowing into the treatment apparatus so that the sum of the cross-sections of the foils 25 and 26 is two thirds of the cross-sectional area, whereby the pulp is spread evenly to the different zones. Further, similar to FIG. 6 conventional foils should be arranged to the zone 24, with which the screen surface is kept clean. It should be emphasized that in embodiments (FIG. 6 and FIG. 9) both the foils 17 and 29 in the treatment zone of the reject are closed.

Figure 14:
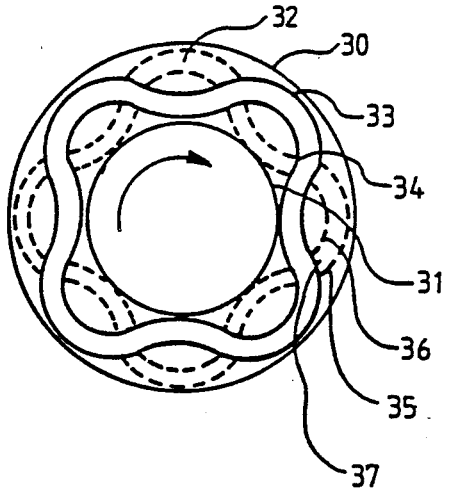
FIG. 14 is a schematic illustration of another embodiment of the apparatus in accordance with the invention.

FIG. 14 discloses as another alternative apparatus a screen apparatus, in which similar to the previous embodiment are two screen cylinders 30 and 31, the treatment space 10 between them and a rotor rotating in it. The rotor comprises, however, two wavily bent plates 33 and 34 or like, which are arranged at certain distances from each other so that cross-sectional area of the space 32 between the plates and the screen surfaces is about the same as the open surface between the plates. Thereby the construction corresponds in the operational principle to the arrangement shown in FIG. 6. If, again, operation similar to that of FIG. 9 is required, then, for example, the distance of the plates from each other has to be increased so that the cross-sectional area between them is two thirds of the cross-sectional area of the treatment space, whereby also two thirds of the suspension is drawn to the said space. The division between the second and the third treatment zone may be carried out later. The second alternative is to arrange plate surfaces within the other exactly as many as there are treatment zones of the unsorted suspension, whereby the suspension may be divided into different zones preliminarily already when flowing into the treatment space. By arranging the bendings of the plates 33 and 34 in suitable form, it is possible to ensure the effect of cleaning the screen surface of the rotor in accordance with the invention. Plates 33 and 34 are mounted from their lower end to a plate corresponding to the intermediate plate 16 of FIG. 6, to the other side of which plate plates 35 and 36 are mounted, and the open surface 37 which is between the plates 35 and 36 is arranged to meander crossing the open surface of 32 between plates 33 and 34 in the way that the reject accumulating in the parts remaining between the plates 33 and 34 and screen surfaces 30 and 31 is easily drawn through the openings of the intermediate plate to the open space between plates 35 and 36. Respectively, also by varying these plate arrangements it is possible to create a screen apparatus with four or more zones as is already briefly shown above.

Although only two different constructional alternatives have been shown above for the rotor of the apparatus in accordance with the invention and primarily two different zone divisions, it is clear that the scope of invention extends also to other rotor alternatives realizing the same principal requirements and that the number of the zones is restricted only by the production technique of the rotor and the height of the screen cylinder in use. It can clearly be seen from the above examples that the more feed zones for the suspension and discharge zones for the reject are provided in the apparatus, in other words the more often the reject is discharged from the treatment space during the screening process, the greater benefit may be achieved by the method in accordance with the invention. It is not substantial for the method and apparatus in accordance with the invention, whether there are one or more screen cylinders in the apparatus to which the invention is applied. Although both previous examples have two screen cylinders, the invention operates quite respectively also with one screen cylinder. Thereby the rotor may be formed in another way, which arrangement is also included in the scope of protection of the invention. Thus the disclosed examples are not intended to restrict the invention in any way apart from what is said in the accompanying claims which alone define the scope of the invention and its extent. Only a few most advantageous embodiments have been illustrated above, method and apparatus according to which may be applied in communication with the already existing technique. Thus, for example, the rotors in accordance with the invention may directly be installed to replace the the rotors of already existing screen apparatuses, whereby the capacity of said screen apparatuses increases without any external changes in the apparatus.

I claim:

1. A method of treating a fiber suspension, comprising: providing a treatment apparatus having treatment zones in which the suspension is divided into an acceptable fraction and a rejected fraction, the zones including a reject treatment zone to which all of the rejected fraction is delivered; feeding the fiber suspension into the treatment apparatus; dividing the suspension into the acceptable fraction and the rejected fraction; guiding the rejected fraction from one of the treatment zones past at least one adjacent treatment zone without mixing with the suspension in said at least one adjacent treatment zone to the reject treatment zone; and discharging the fractions from the apparatus as separate flows, including discharging the acceptable fraction still in the suspension in the reject treatment zone separately from the rejected fraction.

2. A method according to claim 1, wherein said dividing step includes dividing the fiber suspension into a number of portions corresponding to the number of treatment zones, said feeding step including feeding the fractions as a continuous flow to respective ones of the treatment zones, said guiding step including guiding the rejected fraction from each of the treatment zones past adjacent treatment zones directly to the reject treatment zone.

3. An apparatus for treating a fiber suspension, comprising: an outer casing; conduits inside the outer casing for a pulp to be fed in, said pulp containing an acceptable fraction of the suspension and a rejected fraction of the suspension; at least one screen cylinder arranged inside the outer casing and having a surface; and rotor means provided so as to be movable with respect to the surface of the screen cylinder and so as to define a treatment space therebetween, the rotor means including first members provided so as to define separate treatment zones and a second member provided so as to define a reject treatment zone in the treatment space, said first members being arranged so as to lead suspension which accumulates in the treatment space from said separate treatment zones to said reject treatment zone past treatment zones therebetween so that said suspension which accumulates does not mix with suspension in the treatment zones therebetween.

4. An apparatus according to claim 3, wherein the members include hollow foil-like members having an outer surface arranged so as to keep the screen surface clean and a hollow space through which the rejected fraction is guided to and from the separate zones and to the reject treatment zone.

5. An apparatus according to claim 4, wherein said members further include intermediate plates, said foil-like members being mounted to said intermediate plates, said intermediate plates having openings corresponding to said foil-like members so as to allow the rejected fraction to flow through the openings into and out of said foil-like members.

6. An apparatus according to claim 5, wherein some of said foil-like members pass through the openings in said intermediate plates.

7. An apparatus according to claim 3, wherein said members include bent, unround members of a plate-like construction, said bent members being arranged so as to define a space therebetween through which either of the suspension and the rejected fraction is respectively guidable to the separate zones of the treatment space, and from the separate zones to the reject treatment zone.

* * * * *